US007841792B2

(12) United States Patent
Cook et al.

(10) Patent No.: US 7,841,792 B2
(45) Date of Patent: Nov. 30, 2010

(54) PERIPHERAL WITH ADJUSTABLE INPUT AND OUTPUT TRAYS

(75) Inventors: Brian Dale Cook, Nicholasville, KY (US); Donald Paul McCoy, Georgetown, KY (US); Mark Connelly Ott, Waddy, KY (US)

(73) Assignee: Lexmark International, Inc., Lexington, KY (US)

( * ) Notice: Subject to any disclaimer, the term of this patent is extended or adjusted under 35 U.S.C. 154(b) by 611 days.

(21) Appl. No.: 11/842,667

(22) Filed: Aug. 21, 2007

(65) Prior Publication Data

US 2009/0052967 A1 Feb. 26, 2009

(51) Int. Cl.
*B65H 1/04* (2006.01)
*B65H 1/02* (2006.01)
*B65H 31/00* (2006.01)

(52) U.S. Cl. ..... 400/624; 400/693; 271/162

(58) Field of Classification Search ..... 400/693, 400/624, 629; 347/108; 271/162
See application file for complete search history.

(56) References Cited

U.S. PATENT DOCUMENTS

| | | | | |
|---|---|---|---|---|
| 5,917,995 | A * | 6/1999 | Ota | 358/1.12 |
| 6,447,188 | B2 * | 9/2002 | Ishizaki | 400/691 |
| 6,752,554 | B1 * | 6/2004 | Brittingham | 400/693 |
| 6,830,400 | B2 * | 12/2004 | Yerg nson | 400/693 |
| 2004/0032481 | A1 * | 2/2004 | Sides, II | 347/108 |

FOREIGN PATENT DOCUMENTS

| | | | |
|---|---|---|---|
| JP | 01317951 | A * | 12/1989 |
| JP | 05030294 | A * | 2/1993 |
| JP | 2002087602 | A * | 3/2002 |
| JP | 2006205398 | A * | 8/2006 |

* cited by examiner

*Primary Examiner*—Daniel J Colilla
(74) *Attorney, Agent, or Firm*—John Victor Pezdek

(57) ABSTRACT

A peripheral, such as a printer, includes a peripheral body, a first tray arcuately moveable about the body, and a second tray arcuately moveable about the body allowing for various media feed path arrangements between the first and second trays.

21 Claims, 10 Drawing Sheets

PERIPHERAL WITH ADJUSTABLE INPUT AND OUTPUT TRAYS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to devices having media feed mechanisms and more particularly to a media feed mechanism having adjustable trays allowing for different media feedpath configurations depending upon a user's desired feedpath layout.

2. Description of the Related Art

Inkjet printers and all-in-one devices, which are commonly known, generally utilize a media input tray and a media output tray defining start and end points, respectively of a media feedpath. The devices usually come in either of two configurations. In one configuration the media feedpath is generally U-shaped or C-shaped with a media input tray above or below the media output tray. The U-shaped device generally positions the input media tray and output media tray at the front of the device. Alternatively, an L-shaped paper path may be utilized wherein an input tray may be located at the rear of a printer and is generally upwardly directed while the media output or exit tray extends horizontally from the front of the device, thereby defining the L-shaped feedpath. The feedpath configurations are generally fixed because the trays may not be moved.

One problem with existing print devices and media feeding peripheral is that they utilize critical workspace on a user's desk or office furniture. Due to workspace limitations, it would be desirable to allow users to orient or configure the media trays in such a way that minimizes use of desktop space and best fits the constraints of their work area. Such adjustability of configuration would allow the user to place the printer or all-in-one device into their workspace with greater ease providing greater freedom and flexibility in print device usage.

SUMMARY OF THE INVENTION

A peripheral device comprises a body, a first tray connected to the body, a second tray connected to the body, the first tray defining a first portion of a feedpath and the second tray defining a second portion of the feedpath, at least one of the first tray and the second tray pivotable about the printer body. Each of the first tray and the second tray are pivotable about the printer body. One of the first tray and the second tray is pivotable through an arc of about 200 degrees and the other of the first and second tray is pivotable through an arc of about 100 degrees. The peripheral further comprises a media feed mechanism in at least one of the first tray and the second tray. The peripheral further comprises a media feed mechanism in each of the first tray and the second tray.

A peripheral comprises a peripheral body, a first tray arcuately moveable about the body, and a second tray arcuately moveable about the printer body. The peripheral further comprises the body being substantially cylindrical. The peripheral further comprises the body having a display. The peripheral further comprises the first and second tray being configurable into a U-shaped feedpath. The first and second trays are configurable into a L-shaped feedpath. Alternatively, the first tray and the second tray are configurable into a straight-through feedpath. The first and second trays are configurable into various positions spaced about the body.

A peripheral comprises a body, a first tray movable about the body through a first path, and, a second tray movable about the body through a second path. The first and second trays are arrangeable in a vertical U-shaped feedpath configuration. The peripheral first and second trays are arrangeable in a horizontal U-shaped feedpath configuration. The peripheral first and second trays are arrangeable in a straight-through feedpath. The peripheral first and second trays are moveable to an L-shaped configuration. The peripheral first and second trays are moveable to an acute angled feedpath arrangement. The peripheral first and second trays are moveable to an obtuse angled feedpath arrangement. At least one of the first tray and the second tray includes a feeding mechanism.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
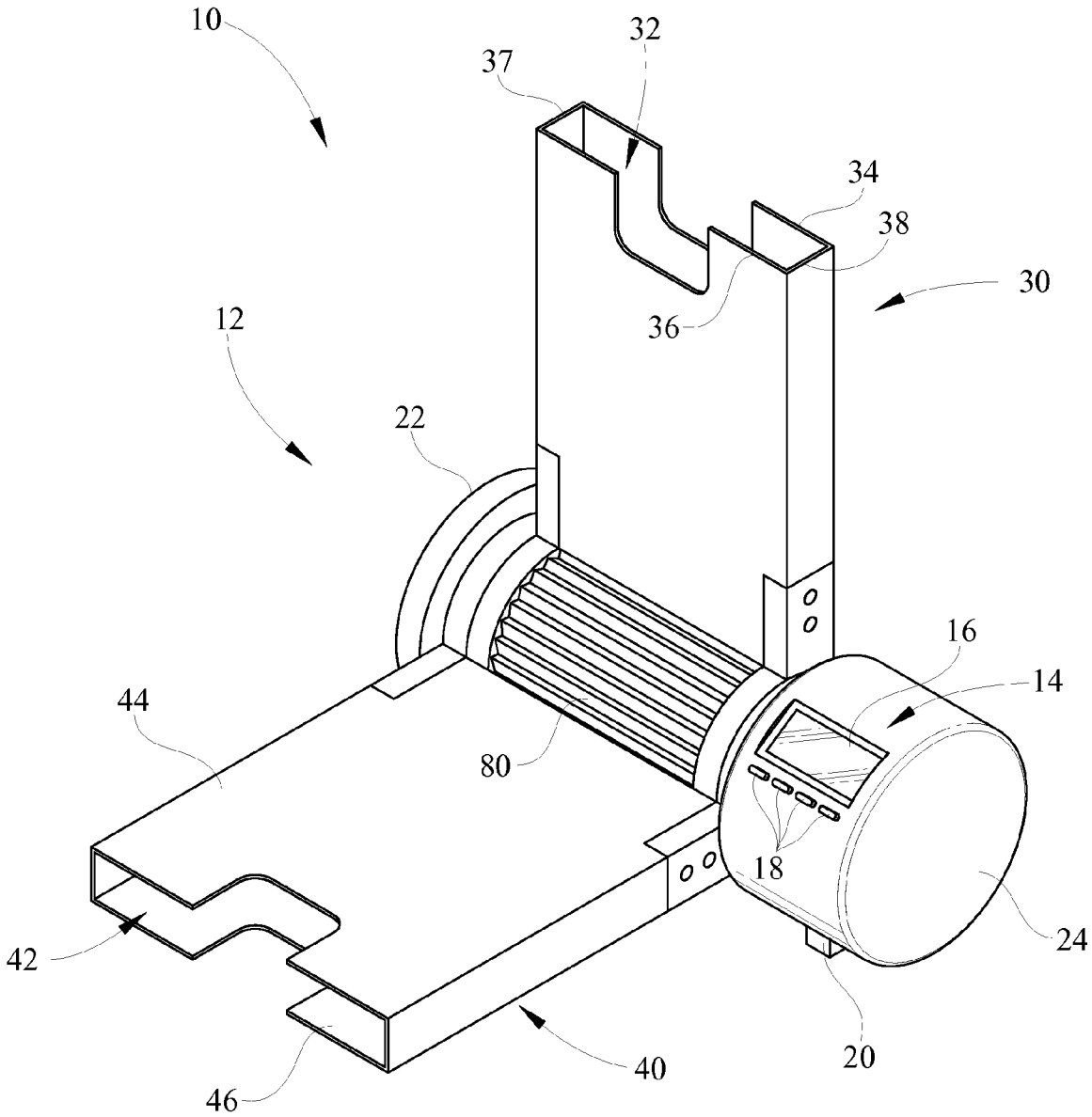
FIG. 1 is a perspective view of a printer having adjustable input and output trays.

The following description and drawings illustrate embodiments of the invention sufficiently to enable those skilled in the art to practice it. It is to be understood that the invention is not limited in its application to the steps of the method, the details of construction and the arrangement of components set forth in the following description or illustrated in the drawings. The invention is capable of other embodiments and of being practiced or of being carried out in various ways. For example, other embodiments may incorporate structural, chronological, electrical, process, and other changes. Examples merely typify possible variations. Individual components and functions are optional unless explicitly required, and the sequence of operations may vary. Portions and features of some embodiment may be included in or substituted for those of others. The scope of the invention encompasses the appended claims and all available equivalents. The following description is, therefore, not to be taken in a limited sense, and the scope of the present invention as defined by the appended claims.

Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

In addition, it should be understood that embodiments of the invention include both hardware and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software. As such, it should be noted that a plurality of hardware and software-based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

The term image as used herein encompasses any printed or digital form of text, graphic, or combination thereof. The term output as used herein encompasses output from any printing device such as color and black-and-white copiers, color and black-and-white printers, and so-called "all-in-one devices" that incorporate two or more functions such as scanning, copying, printing, and faxing capabilities in one device. Such printing devices may utilize ink jet, dot matrix, dye sublimation, laser, and any other suitable print formats. The term button as used herein means any component, whether a physical component or graphic user interface icon, that is engaged to initiate output. The term media and paper may be used interchangeably herein and may include plain paper, photo paper, card stock, transparency, Mylar, fabric, or other printable materials.

The present invention provides a media feed assembly with adjustable input and output trays. Referring now to FIG. 1, a perspective view of a peripheral, in this illustrative embodiment a print device 10 is depicted. Although a print device is shown and described, it is well within the scope of the present invention that a scanner or other peripheral may be substituted for the printer which utilizes a media feeding assembly. However, for simplicity a printer will be described. The printer 10 comprises a body 12 which is generally cylindrical in shape, with a circular cross-section, although such shape should not be considered limiting and others may be utilized. For example, an alternative body may comprise a polygonal cross-section such as a hexagon or an octagon providing multiple locations for positioning trays 30, 40. At one position on the body 12 is a control panel 14 which may comprise a display 16 as well as plurality of control buttons 18. Disposed on the bottom of the body 12 is at least one base 20 which stabilizes the body 12 and is desirable due to the exemplary cylindrical shape of the body 12 which might otherwise roll.

The body 12 further comprises a first end 22 and a second end 24 and the control panel 14 is depicted near one of the first end 22 and second end 24. The first and second ends 22, 24 capture a first tray 30 and a second tray 40. For purpose of the illustrative description, the first tray 30 may be considered a media input tray and the second tray 40 may be considered a media output tray. However, the first tray and the second tray 30, 40 may alternatively be an output tray or an input tray, respectively. The first tray 30 is generally rectangular with an open-end 32 wherein media may be positioned for feeding through the body 12. The tray 30 comprises a first surface 34 and a second surface 36 which are spaced apart by sidewalls 37, 38 in order to define the opening 32. The opening 32 comprises a preselected dimension for receiving a media stack so that a user does not have to load a media sheet separately each time a sheet is printed by the printer 10, as will be understood by one skilled in the art.

Likewise, the second tray 40 comprises an opening 42 defined by the spaced apart distance between a first surface 44 and a second surface 46 and sidewalls therebetween. The opening 42 may receive a stack of media of a preselected thickness as the media sheets are printed upon. Although, the trays 30, 40 are shown with a particular construct, other designs may be utilized and therefore are within the scope of the present invention. The trays 30, 40 should merely be connectable to the body 12 in a moveable fashion as will be understood by one of ordinary skill in the art.

Figure 2:
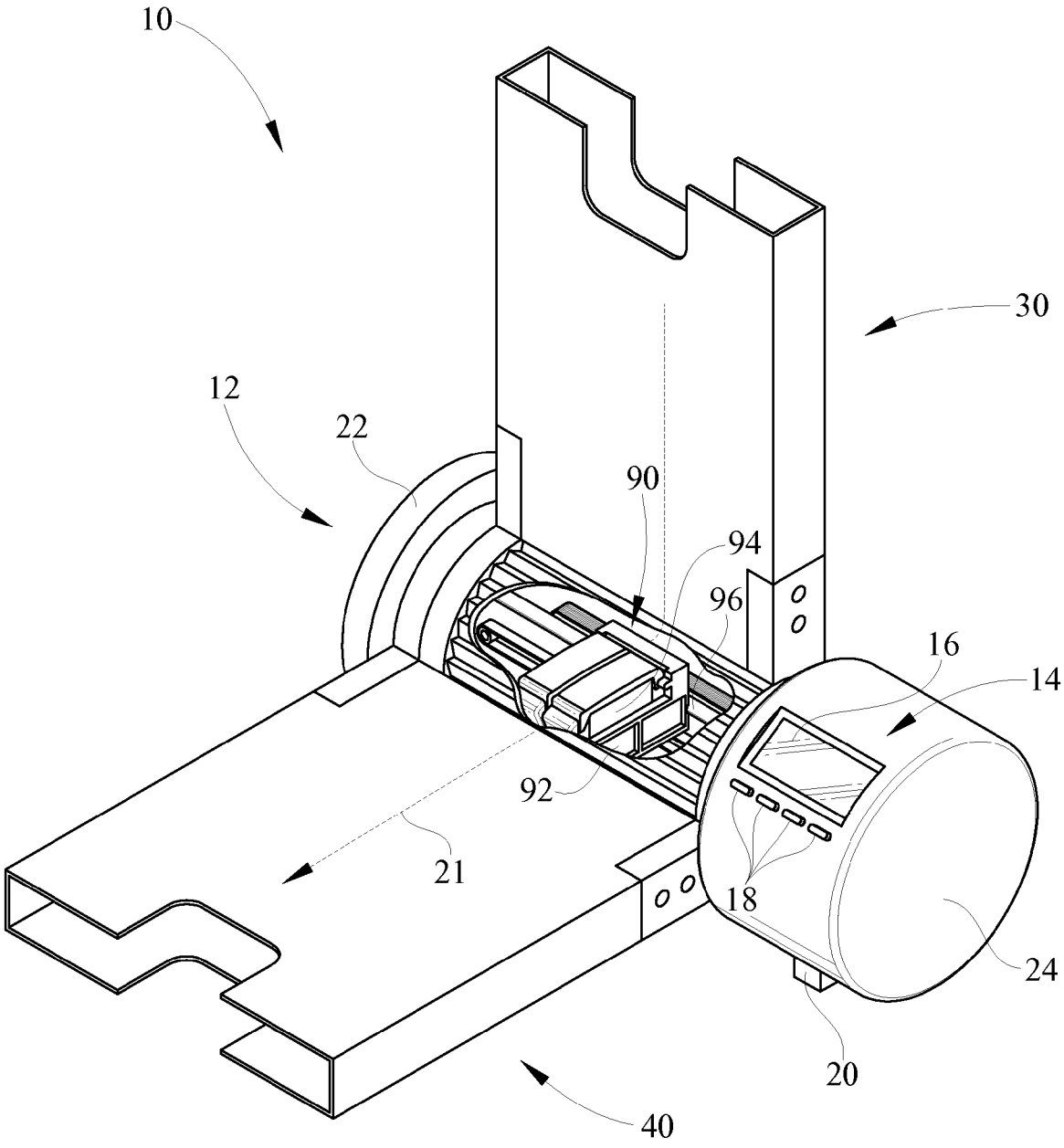
FIG. 2 is a cut-away perspective view of the printer of FIG. 1.

Referring now to FIG. 2, the body 12 is depicted with a cutaway portion revealing the interior. Within the body 12, adjacent the control panel 14 is a controller (not shown) which may be embodied by a microprocessor. The controller may be in data communication with a host computer. The controller also directs a print assembly 90 to move and selectively eject ink droplets on the media moving from the first tray 30 to the second tray 40 and through the body 12. The controller also controls feed mechanisms within the first tray 30 and second tray 40 as well as receives inputs from the buttons 18. Likewise, the controller provides output to the display 16 to notify users of messages, menus, error conditions and the like.

The controller also directs the print assembly 90 comprising a carriage 92 which is slideably connected to a slide rail 96. The slide rail 96 extends from the first end 22 to the second end 24 of body 12 and may be supported by a chassis (not shown) within the body 12. The carriage 92 moves along the slide rail 96 in a direction which is substantially transverse to a media feedpath extending from the first tray 30 through the body 12 to the second tray 40. The carriage 92 houses at least one cartridge 94 containing ink and a print head for selectively ejecting ink onto media passing in the print zone which is defined beneath the carriage 94 and within the body 12. According to the exemplary embodiment the carriage 92 houses two cartridges one for color printing, containing for example, cyan, magenta and yellow color inks as well as a second cartridge which may contain black ink for printing text gray-scale and non-color documents.

According to an exemplary embodiment, and as previously described, a scanner function may be substituted for the print assembly 90. In such an embodiment, a scan bar may be positioned within the housing or body 12 so that images may be scanned as the media passes through the body 12 along the feedpath 21. A stationary scan bar may be utilized within body 12 or a movable scan bar may be utilized alone or with the print assembly 90 to provide both printing and scanning function. In such embodiment, the trays 30, 40 would define start and end points of the target document feedpath. For example, a scan bar is generally either an optical reduction type using a combination of lens, mirror and a CCD (Charge Coupled Device) array or CIS (Contact Image Sensors) array. The CCD array is a collection of tiny, light-sensitive diodes, which convert photons into electrons. These diodes are called photosites—the brighter the light that hits a single photosite, the greater the electrical charge that will accumulate at that site. The image of the document that is scanned using a light source such as a fluorescent bulb reaches the CCD array through a series of mirrors, filters and lenses. The exact configuration of these components will depend on the model of scanner. Some optical reduction scanners use a three pass scanning method. Each pass uses a different color filter (red, green or blue) between the lens and CCD array. After the three passes are completed, the scanner software assembles the three filtered images into a single full-color image. Most optical reduction scanners use the single pass method. The lens splits the image into three smaller versions of the original. Each smaller version passes through a color filter (either red, green or blue) onto a discrete section of the CCD array. The scanner software combines the data from the three parts of the CCD array into a single full-color image.

Alternatively, for less expensive flatbed scanners and those with size limitations, contact image sensors (CIS) are used in the scan bar (not shown). CIS arrays replaces the CCD array, mirrors, filters, lamp and lens with an array of red, green and blue light emitting diodes (LEDs) and a corresponding array of phototransistors. The image sensor array consisting of 600, 1200, 2400 or 4800 LEDs and phototransistors per inch (depending on resolution) spans the width of the scan area and is placed very close to the glass plate upon which rest the image to be scanned. Another version of the CIS used a single set of red, green and blue LEDs in combination with light pipes to provide illumination of the material to be scanned. When the image is scanned, the LEDs combine to provide a white light source. The illuminated image is then captured by the row of sensors. CIS scanners are cheaper, lighter and thinner, but may not provide the same level of quality and resolution found in most optical reduction scanners. Color scanning is done by illuminating each color type of LED separately and then combining the three scans.

As shown in FIGS. 1 and 2, the first tray and the second tray are positioned in a substantially L-shaped configuration and therefore define an L-shaped feedpath 21 for printing. The first tray 30 and the second tray 40 are each moveable through various positions in order to vary the feedpath 21 configuration between for example an L-shaped path, a U-shaped path, a straight-through feedpath, an acute angled feedpath or an obtuse angled feedpath. In order to accomplish such goal of moving the first and second tray 30, 40, the body 12 acts as a pivot axis for another structure utilized to allow the first tray 30 and the second tray 40 to rotate. The body 12 has a circular cross-section but other cross-sectional shapes may be utilized.

Figure 3:
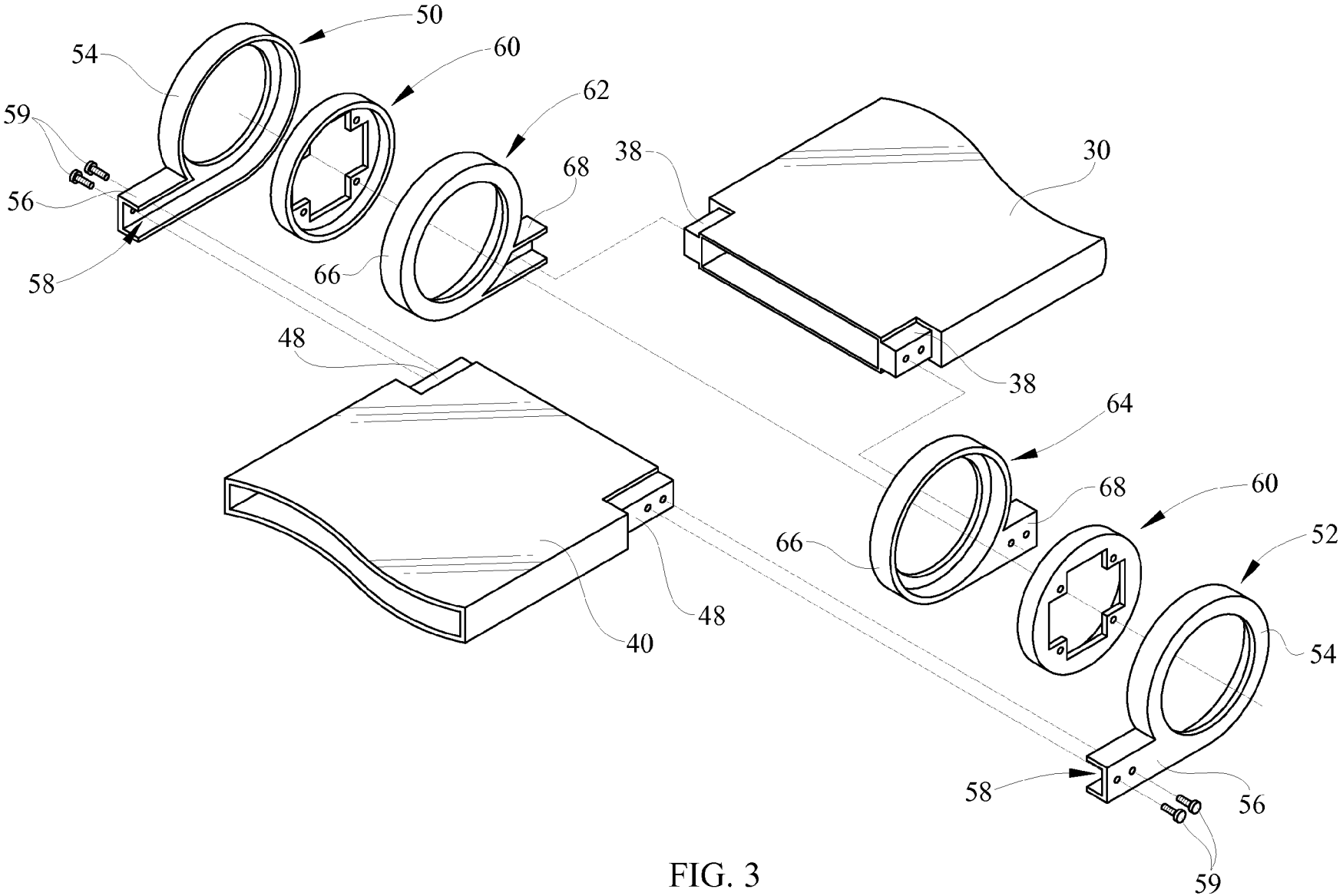
FIG. 3 is an exploded perspective view of the first tray, the second tray and the assembly components allowing movement of the trays.

Referring now to FIG. 3 an exploded view of the first tray 30, and the second tray 40 and the assembly components is shown is perspective view. As previously described, the body 12 is cylindrical in shape, thus having a circular cross-section. The second tray 40 is held in position by pivot arms 50, 52 each having a collar portion 54 and an arm portion 56 extending from the collar 54. The collar 54 has a complimentary circular cross-section and is sized to receive a hub 60 which is connected to the body 12 or chassis therein. Alternatively, the collar 54 may vary in shape depending, in part, on the cross-sectional shape of body 12 but may have a circular opening located therein. The exemplary hub 60 is circular and sized to fit within the opening of the collar 54. The hub 60 remains stationary so that the pivot arms 50, 52 may rotate about each hub 60 disposed within the collar 54. According to the exemplary embodiment, each hub 60 has a width which provides spacing for an inner pivot arm 62, 64 and an outer pivot arm 50, 52.

The tray hub 60 extends through or is received by an opening in the collar 54. Thus each tray hub 60 provides a bearing surface about which the pivot arms 50, 52 and 62, 64 may rotate Additionally, the tray hubs 60 and collars 54, 66 have openings through which the slide rail 96 and print assembly 90 may extend.

The assembly further comprises inwardly offset pivot arms 62, 64. The pivot arms 62, 64 each also comprise a collar portion 66 for receiving the hubs 60 as well as arm portions 68 extending from the collar portions 66. As one skilled in the art will understand, the innermost pivot arms 62,64 are offset from the outermost pivot arms 50,52. Accordingly, the complimentary slides 38 of the tray 30 are inset further than the slides 48 of the tray 40. The slides 38 and 48 are spaced apart to inhibit interference with the media feeding therethrough. For example, the trays 30 and 40 may be dimensioned to compensate for the maximum width needed for preselected media sizes. Further, it is well within the scope of the present invention that the inner pivot arms 62, 64 and outer pivot arms 50, 52 may be reversed to retain the opposite trays 40,30 respectively so long as the trays 30,40 are formed complimentarily to compensate for such offset of the pivot arms.

The pivot arms 50, 52, 62, 64 are movable such that one of the trays 30,40 is pivotable through an arc of about 200 degrees while the other of the trays 30,40 is pivotable through an arc of about 100 degrees. The tray hub 60 and pivot arms 50, 52, 62, 64 may have a frictional engagement such that the trays 30, 40 cannot move without user applied force. Alternatively, the hub 60 and pivot arms 50, 52, 62, 64 may utilize a plurality of teeth, detents, tabs, protrusions or other complimentary engagement or clutch features to retain the trays 30, 40 in the positions to which they are moved by the user.

In the exemplary embodiment outer pivot arms 50, 52 are connected to the output tray 40 and the inner pivot arms 62, 64 are connected to the input tray 30. Extending from the collar 52, the arm portion 58 of each pivot arm 52, 54 has some pre-selected shape. In the exemplary embodiment the arm portions 56 are generally C-shaped having a channel 58 to receive a complimentary slide portion 48 of the trays 40. In the exemplary embodiment, the slide 48 is received within the channel portion 58 so that fasteners 59 may be disposed through the arm portion 58 and into the tray 40. Likewise, the inner pivot arms 62, 64 comprise arms 68 which receive slides 38 of the input tray 30. Although a C-shaped arm structure is depicted in the exemplary embodiment, such design configuration should not be considered limiting as various other complimentary shapes may be utilized. Further, alternative mounting designs are well within the scope of the present embodiment so that the trays 30, 40 are movable about the body 12.

Figure 14:
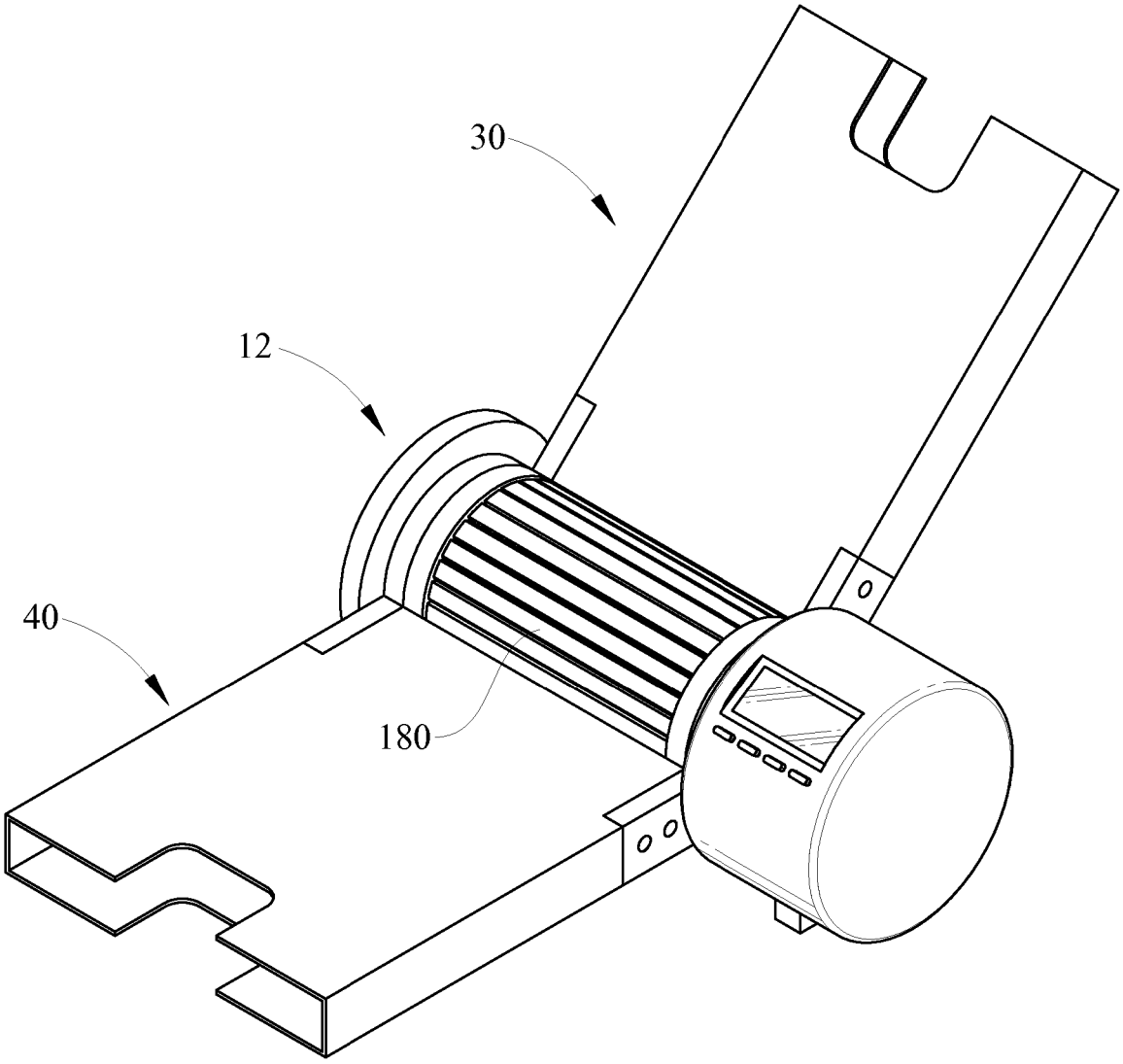
FIG. 14 is a perspective view of the printer of FIG. 1 with the trays arranged in an obtuse feeding angle.

Referring now to FIGS. 1-3, a flexible skirt 80 is depicted extending from the first tray 30 to the second tray 40. One skilled in the art will realize that in order for media to move through the body 12 at the various positions of the trays 30, 40, the body 12 must generally be open around the outer circumference to receive media from the various positions where the trays 30, 40 may be moved. With the body 12 generally open, some cover needs to be positioned between the first tray 30 and the second tray 40 so that the internal components within the body 12 are not exposed in the positions where the trays 30, 40 are not located. Also, such cover may be positioned on opposite sides of the trays 30, 40 and extend about the body 12 to generally at or near the base 20. According to the present embodiment, the skirt 80 may be structured similarly to an accordion-like material which stretches as the trays 30, 40 move apart and relaxes as the trays 30,40 move together. The skirt 80 may be formed of plastic, structured fabric material or other forms which are common in manufacturing. The skirt 80 should also have enough rigidity that it is not easily breakable or forced inwardly by a user which could damage components of the print assembly 90. As shown in FIG. 14, an alternative embodiment may comprise a plurality of blades or slats 180 which are telescoping about the arc shape of the body 12. The blades 180 therefore compensate for movement of the trays 30,40 around the body 12 by extending or retracting.

Figure 4:
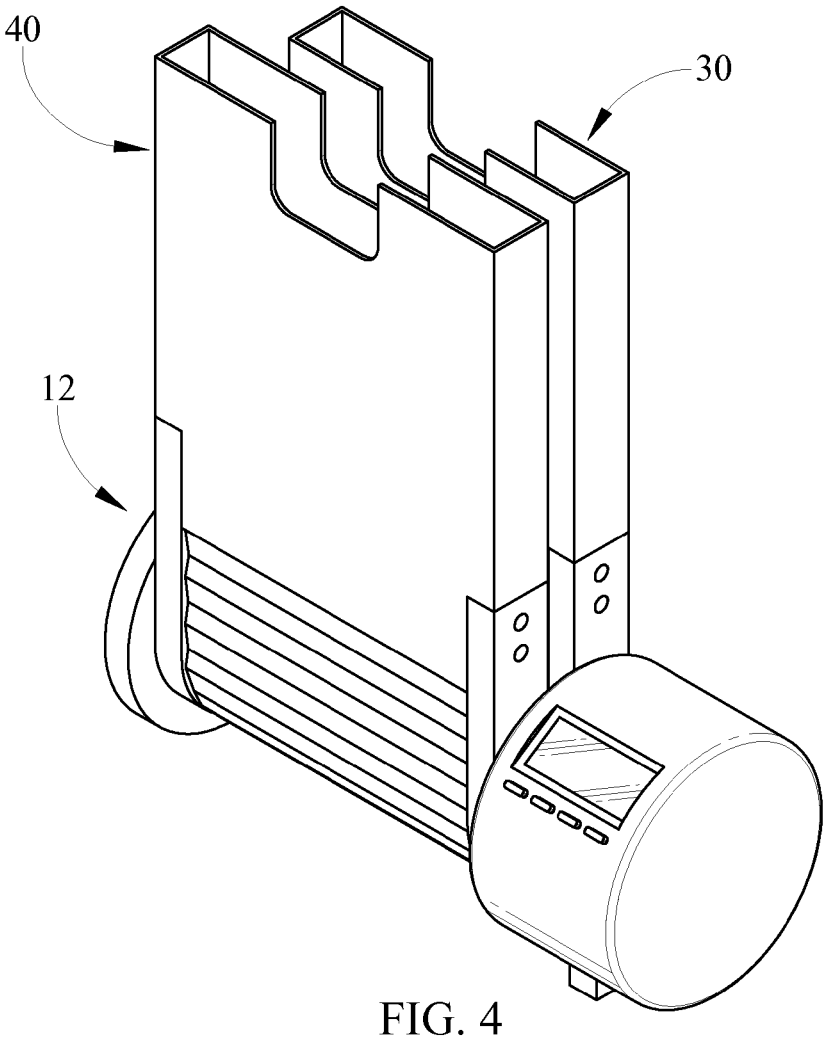
FIG. 4 is perspective view of the printer of FIG. 1 with the trays arranged in a vertical U-shaped configuration.
Figure 5:
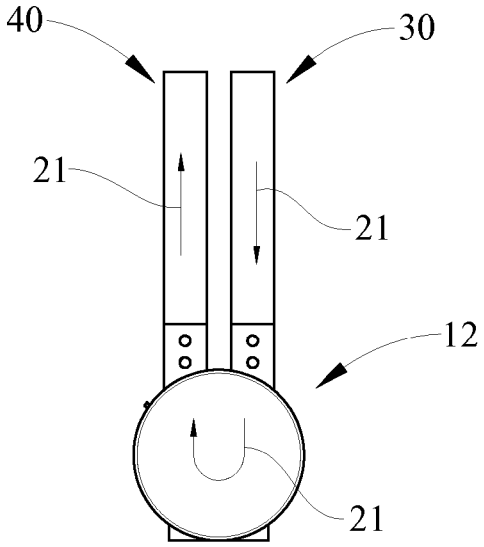
FIG. 5 is a side view of the printer of FIG. 4.

Referring now to FIGS. 4 and 5, the printer 10 is shown in a perspective view and a side view. The first tray 30 and the second tray 40 are depicted defining a vertically oriented U-shaped feedpath 21. According to the embodiment depicted the first tray 30 and the second tray 40 are rotated about the body 12, each to a substantially vertical position. The trays 30 and 40 are slightly spaced apart due to the design of the arm portions. In the embodiment depicted, the arms 58, 68 are extending from the collars 54, 66 substantially tangentially. However, the spacing between the trays 30, 40 may be increased or decreased by altering the positioning of the arm portions 56, 68 relative to the collars 54, 66.

Referring still to FIG. 5, a side-view depicts the trays 30, 40 in a substantially vertical position. As shown, the feedpath 21 is substantially U-shaped as such feedpath passes downwardly from the first tray 30 through the body 12 and upwardly through the second tray 40. The trays 30, 40 may be held in position by the frictional engagement between the pivot arms 50, 52, 62, 64 and the hubs 60. Alternatively, other retaining features may be utilized.

Figure 6:
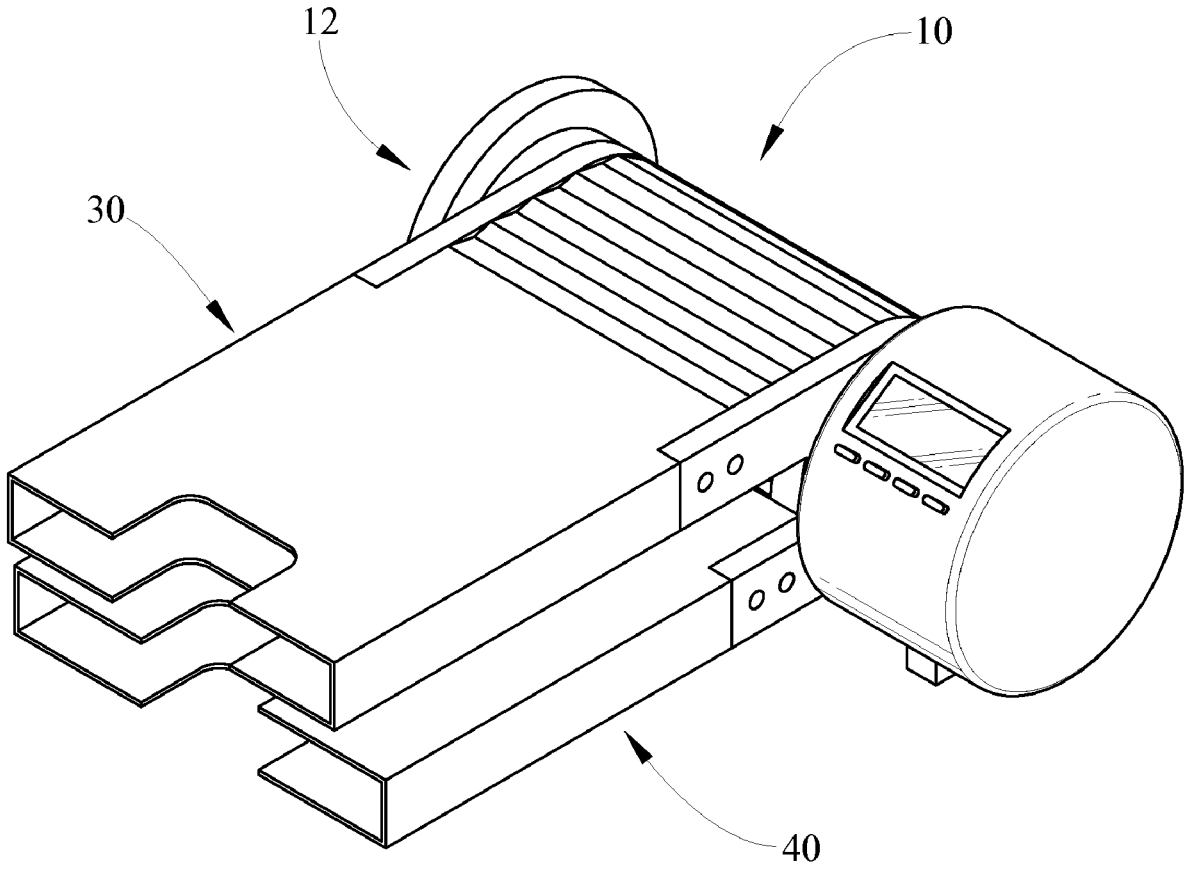
FIG. 6 is a perspective view of the printer of FIG. 1 with the trays arranged in a horizontal U-shaped configuration.
Figure 7:
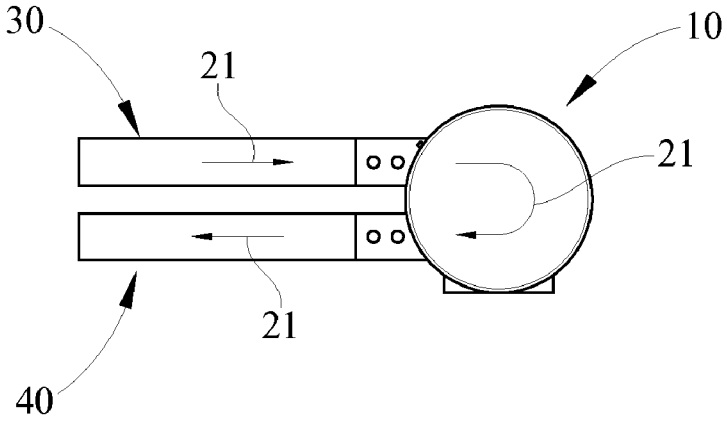
FIG. 7 is a side view of the printer of FIG. 6.

Referring now to FIGS. 6 and 7 the printer 10 is again depicted with the trays 30, 40 moved from the vertical positions depicted in FIGS. 5 and 6. In the exemplary embodiment the trays 30, 40 are moved so as to define a substantially horizontal U-shaped feedpath. In the positions depicted, the first tray 30 is substantially horizontally positioned and the second tray 40 is also substantially horizontally positioned beneath the first tray 30 so that media passes through the first tray 30 within the body 12 and out to the second tray 40. Alternatively, the output tray 40 could be located above the input tray 30, opposite the illustrative embodiment.

Figure 8:
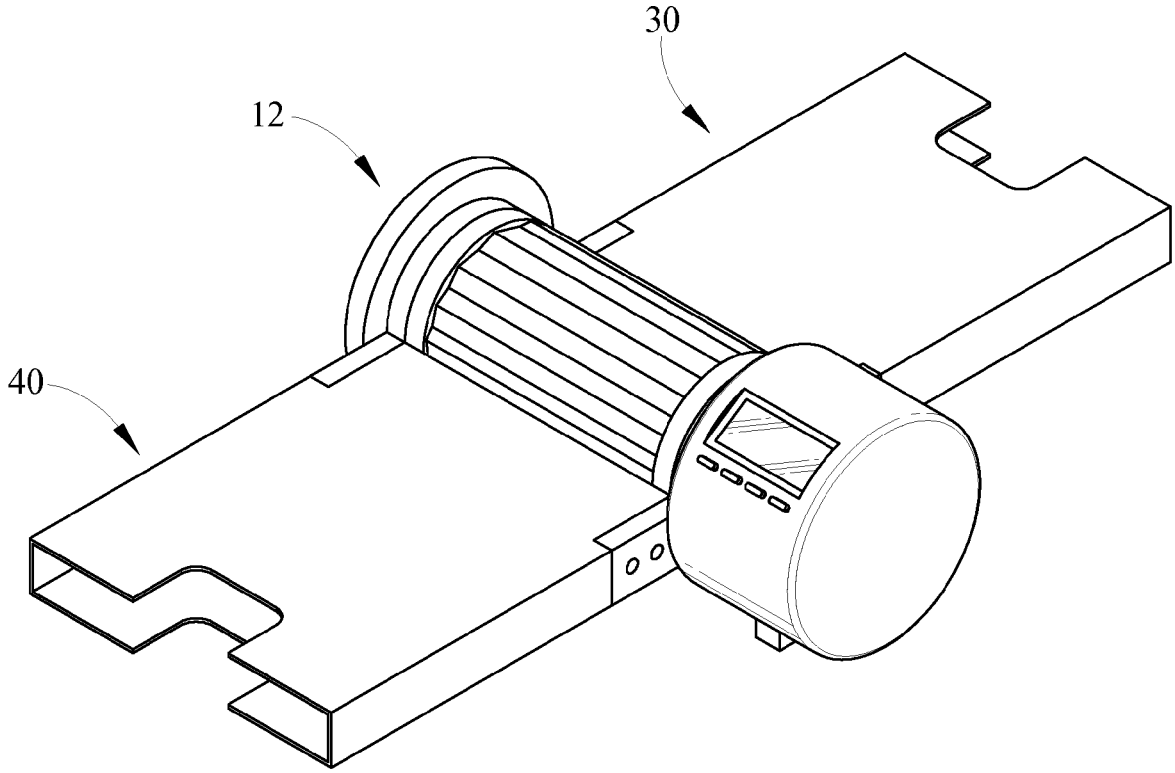
FIG. 8 is a perspective view of the printer of FIG. 1 with the trays arranged in a straight-through configuration.
Figure 9:
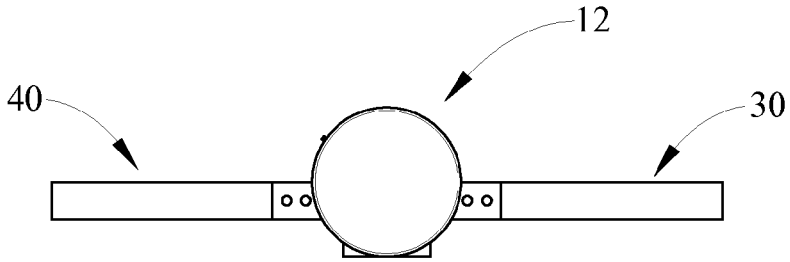
FIG. 9 is a side view of the printer of FIG. 8.

Referring now to FIGS. 8 and 9, the trays 30, 40 are depicted in yet another position. The first tray 30 is shown rotated to a substantially horizontal position to provide a feedpath straight through the body 12 and into the second media tray 40. The first tray 30 is spaced apart from the second tray 40 by about 180 degrees.

Figure 10:
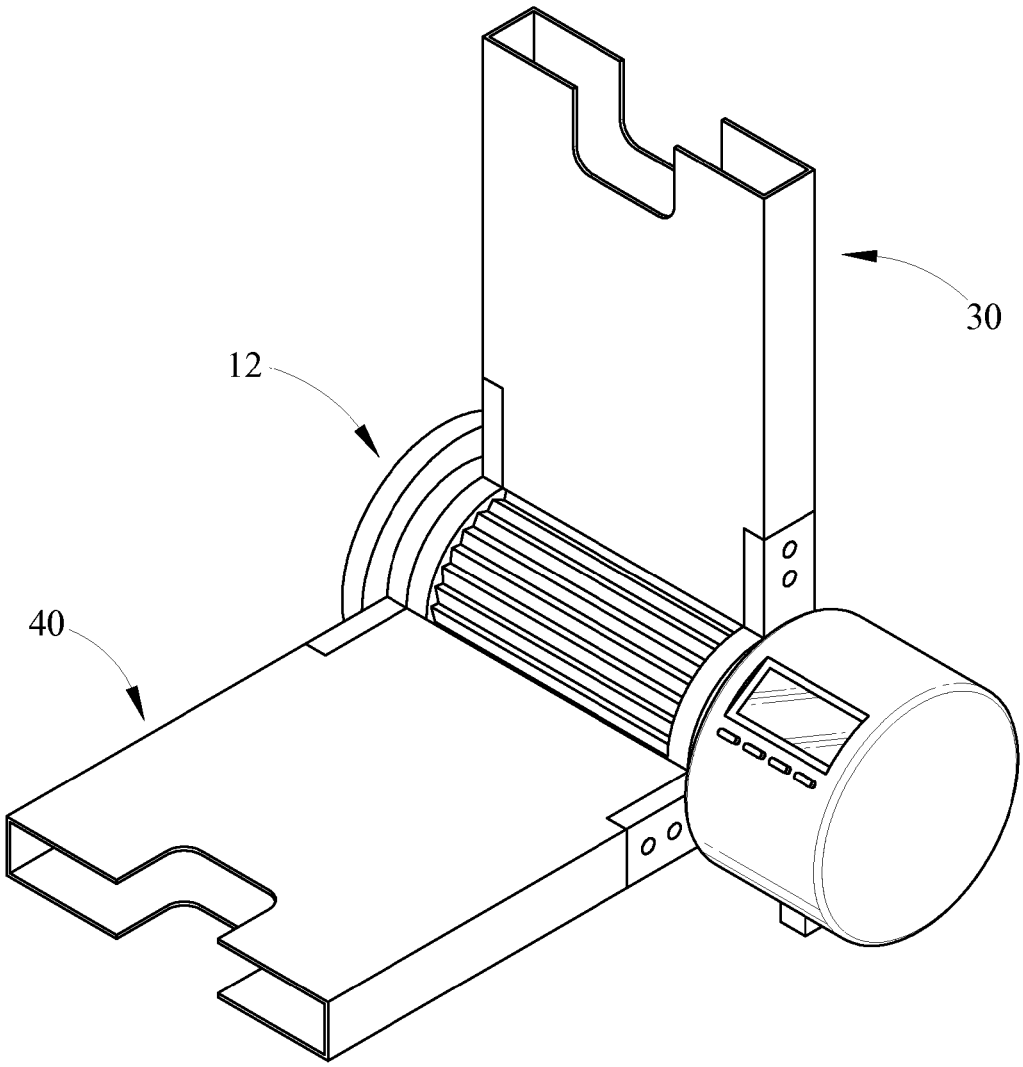
FIG. 10 is a perspective view of the printer of FIG. 1 with the trays arranged in an L-shaped configuration.
Figure 11:
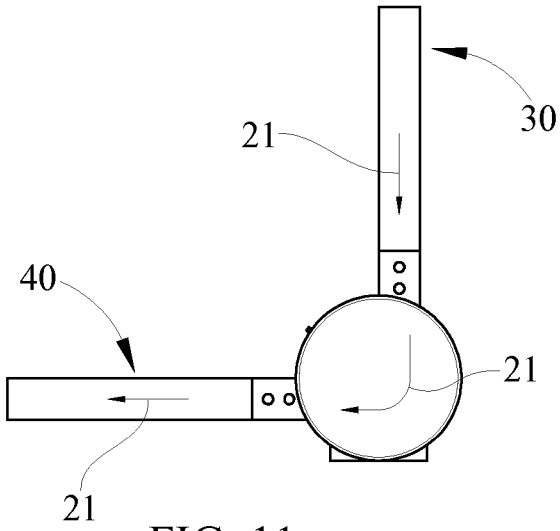
FIG. 11 is a side view of the printer of FIG. 10.

Referring now to FIGS. 10 and 11, the first tray 30 is depicted in a substantially upright position extending from the body 12 while the second tray 40 is depicted extending from the body in a substantially horizontal position. Since the first tray 30 and the second tray 40 are substantially perpendicular to one another the feedpath 21 is generally defined as L-shaped. The trays 30, 40 may be held in place by frictional engagement or by way of engagement features such as ribs, teeth, protuberances or other such releasable design.

Figure 12:
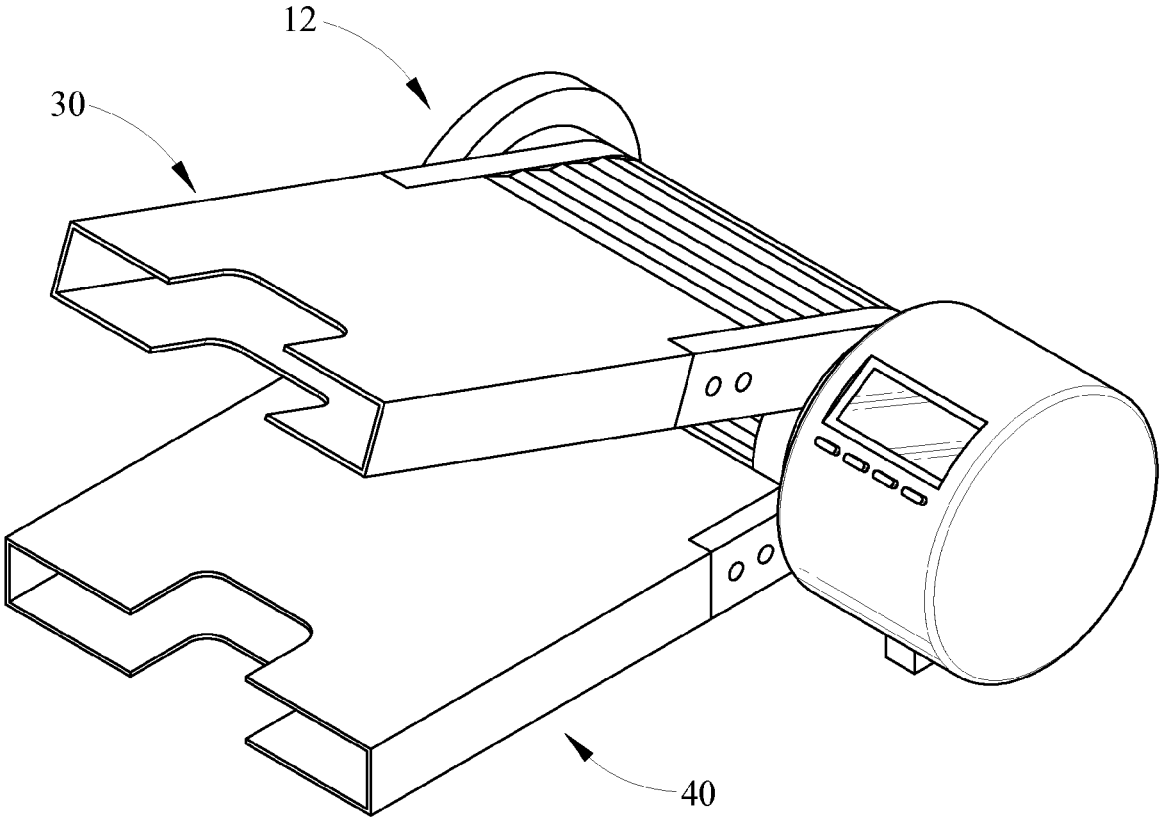
FIG. 12 is a perspective view of the printer of FIG. 1 with the trays arranged in an acute feeding angle.
Figure 13:
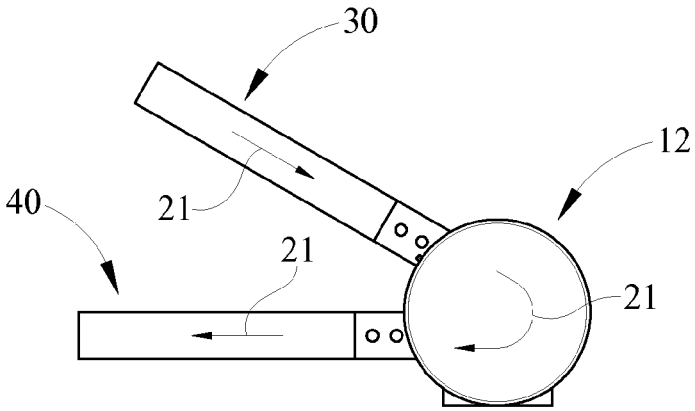
FIG. 13 is a side view of the printer of FIG. 12.

Referring now to FIGS. 12 and 13, the printer 10 is shown with the first tray and second tray 30, 40 depicted in an arrangement wherein the first tray 30 is at an acute angle to the second tray 40. In this configuration the first, upper tray 30 is depicted angled upwardly from the body 12 and the second, lower tray 40 is disposed in a substantially horizontal position extending from the body 12. Media feedpath 21 is shown extending from the first tray 30 downwardly, turning within the body 12, and extending through the second output tray 40. The trays 30, 40 may be releasably held in position by retaining abutments or frictionally, as previously described.

Figure 15:
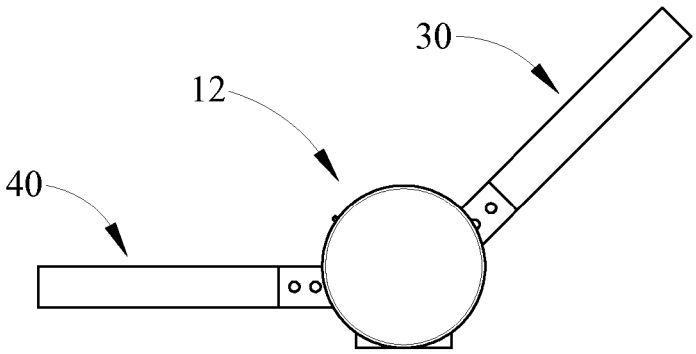
FIG. 15 is a side view of the printer of FIG. 14.

Referring to FIGS. 14 and 15 the first media tray 30 and the second media tray 40 are depicted at obtuse angles from one another. In the depicted embodiments, the first tray 30 extends downwardly into the body 12 at an obtuse angle with respect to the second tray 40, which is extending from the body 12 at a substantially horizontal orientation. Again, the trays 30, 40 may be held in place frictionally or by retaining abutments.

Figure 16:
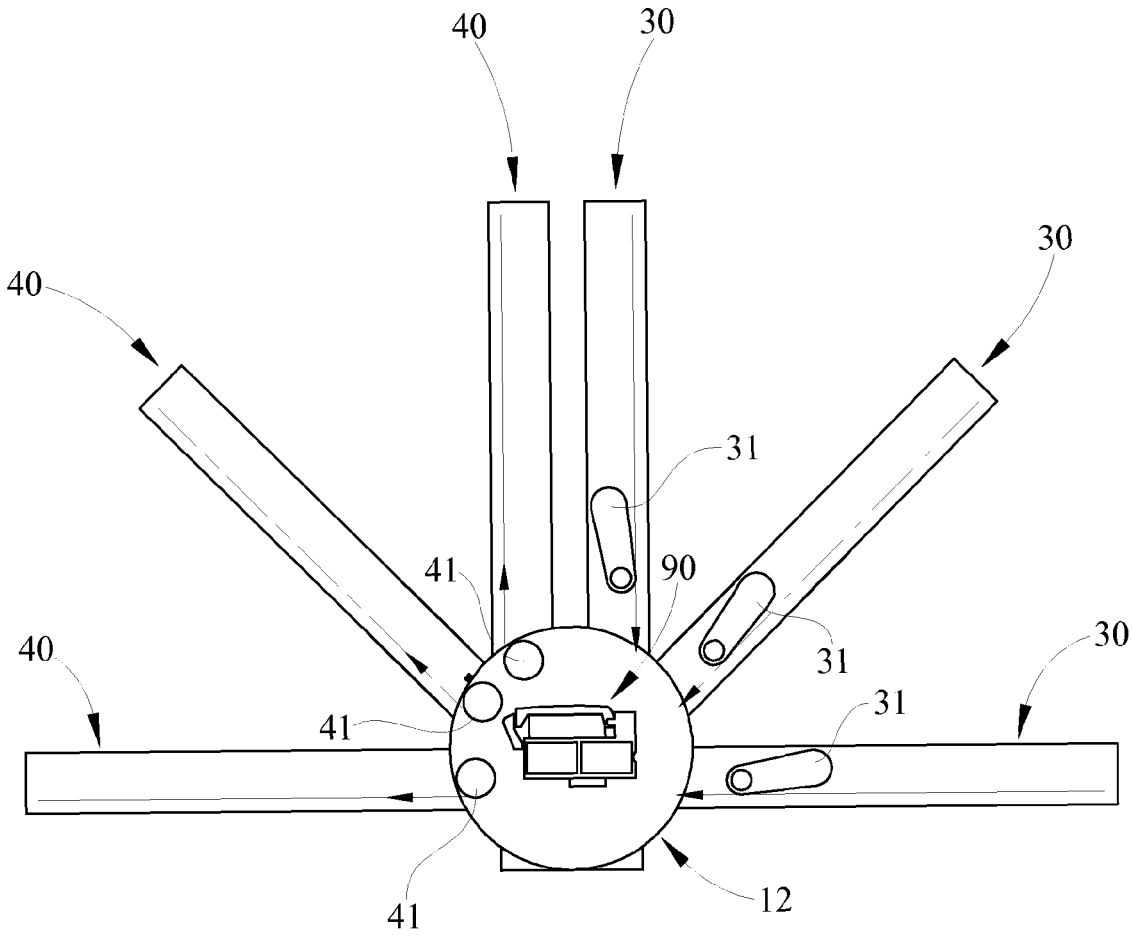
FIG. 16 is a side view of the printer of FIG. 1 with the trays moved to various positions.

Referring now to FIG. 16 a side-view of the printer 10 is depicted with the input tray 30 and the output tray 40 positioned at various orientations relative to the body 12 in a single figure. The input tray 30 may include an auto-compensating mechanism (ACM) 31 having a media pick wheel thereon. A motor for operating the ACM 31 may be located within the tray 30 or within the body 12. In the latter embodiment a transmission such as a gear transmission should allow for movement of the tray 30 about the body 12. The ACM 31 feeds media within the tray 30 from the top of the stack, however the device may alternatively bottom feed.

Adjacent the media output tray 40 within the body is a roller 41. The media feeds along the feedpath 21 through body 12 and is picked by the roller 41 for feeding into the output tray 40. The roller 41 may be located on a shaft or be part of an ACM device 31. The roller 41 must also be able to move with the tray 41 along the body 12 or alternatively may be located within the tray 40. As a result, the roller 41 may be driven by a motor within the body 12 or may be driven by a motor located with the tray 40.

The foregoing description of the various embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A peripheral device, comprising:

a body having a substantially circular cross-section;

a first tray rotatably connected to said body, said first tray rotatably traveling around at least a first portion of an exterior surface of said body;

a second tray rotatably connected to said body, said second tray rotatably traveling around at least a second portion of the exterior surface of said body, said second portion around which said second tray travels overlapping said first portion around which said first tray travels; and said first tray defining a first portion of a media feedpath and said second tray defining a second portion of said media feedpath with the rotatable travel of each of said first tray and said second tray about the exterior of said body allowing the media feedpath to have a multiplicity of configurations.

2. The peripheral device of claim 1 wherein one of said first tray and said second tray is rotatable through an arc of about 200 degrees.

3. The peripheral device of claim 2 wherein the other of said first tray and said second tray is rotatable through an arc of about 100 degrees.

4. The peripheral device of claim 1 further comprising a media feed mechanism in at least one of said first tray and said second tray.

5. The peripheral device of claim 4 further comprising a media feed mechanism in each of said first tray and said second tray.

6. A printer, comprising:

a printer body;

a first tray arcuately moveable around a first portion of said printer body, said first tray defining a first portion of a media feedpath; and a second tray arcuately moveable around a second portion of said printer body, said second portion overlapping said first portion, said second tray defining a second portion of said media feedpath;

wherein said overlapping allows said first tray and said second tray to be moveably positioned allowing said first tray and said second tray to be placed in one of a multiplicity of configurations forming one of a multiplicity of media feedpath configurations.

7. The printer of claim 6 further comprising said body being substantially cylindrical.

8. The printer of claim 6 further comprising said body having a display.

9. The printer of claim 6 further comprising said first and second trays being configurable into a U-shaped media feedpath.

10. The printer of claim 6 wherein said first and second trays are configurable into a L-shaped media feedpath.

11. The printer of claim 6 wherein said first tray and said second trays are configurable into a straight-through media feedpath.

12. The printer of claim 6 said first and second tray configurable into various positions spaced about said body.

13. A peripheral, comprising:

a body;

a first tray movable about an exterior surface of said body through a first path; and, a second tray movable about said exterior surface of said body through a second path, portion of the second path overlapping with a portion of the first path allowing said first and second trays to positioned in one of a multiplicity of feedpath configurations.

14. The peripheral of claim 13 wherein said first and second trays are arrangeable in a vertical U-shaped feedpath configuration.

15. The peripheral of claim 13 wherein said first and second trays are arrangeable in a horizontal U-shaped feedpath configuration.

16. The peripheral of claim 13 wherein said first and second trays are arrangeable in a straight-through feedpath configuration.

17. The peripheral of claim 13 wherein said first and second trays are moveable to an L-shaped configuration.

18. The peripheral of claim 13 wherein said first and second trays are moveable to an acute angled feedpath configuration.

19. The peripheral of claim 13 wherein said first and second trays are moveable to an obtuse angled feedpath configuration.

20. The peripheral of claim 13 wherein at least one of said first tray and said second tray includes a feeding mechanism.

21. The peripheral device of claim 1 wherein the multiplicity of configurations in the media feedpath include a straight-through, a C shape, an L shape, and a U-shape.

* * * * *